US012458828B2

(12) United States Patent
Huang et al.

(10) Patent No.: US 12,458,828 B2
(45) Date of Patent: Nov. 4, 2025

(54) RESISTANCE APPARATUS AND SYSTEM FOR EXERCISE EQUIPMENT

(71) Applicant: WUG ROBOT LLP, Carmel, IN (US)

(72) Inventors: Pu Huang, Carmel, IN (US); Yixu Huang, Carmel, IN (US)

(73) Assignee: Allerbi Inc.

( * ) Notice: Subject to any disclaimer, the term of this patent is extended or adjusted under 35 U.S.C. 154(b) by 177 days.

(21) Appl. No.: 18/086,198

(22) Filed: Dec. 21, 2022

(65) Prior Publication Data

US 2023/0191180 A1 Jun. 22, 2023

Related U.S. Application Data

(60) Provisional application No. 63/292,952, filed on Dec. 22, 2021.

(51) Int. Cl.

*A63B 21/00* (2006.01)
*A63B 21/005* (2006.01)
*A63B 24/00* (2006.01)

(52) U.S. Cl.

CPC .... *A63B 21/00192* (2013.01); *A63B 21/0051* (2013.01); *A63B 24/0062* (2013.01); *A63B 24/0087* (2013.01); *A63B 2024/0093* (2013.01); *A63B 2220/30* (2013.01); *A63B 2220/54* (2013.01); *A63B 2220/833* (2013.01)

(58) Field of Classification Search

CPC ..... A63B 2220/30; A63B 2220/54; A63B 2220/16; A63B 2220/34; A63B 2220/805; A63B 2220/833; A63B 2225/20; A63B 2225/50; A63B 21/00192; A63B 21/0051; A63B 24/0062; A63B 24/0087; A63B 22/06; A63B 22/0605; A63B 22/0076

See application file for complete search history.

(56) References Cited

U.S. PATENT DOCUMENTS

| | | | | |
|---|---|---|---|---|
| 10,639,512 | B2 * | 5/2020 | Huang | A63B 21/015 |
| 11,794,054 | B2 * | 10/2023 | Petrillo | A63B 21/225 |
| 2005/0239601 | A1 | 10/2005 | Thomas | |
| 2009/0011907 | A1 | 1/2009 | Radow et al. | |
| 2010/0035726 | A1 | 2/2010 | Fisher et al. | |

(Continued)

FOREIGN PATENT DOCUMENTS

WO 2021108443 A1 6/2021

*Primary Examiner* — Loan B Jimenez
*Assistant Examiner* — Jonathan A Dicuia
(74) *Attorney, Agent, or Firm* — Gutwein Law; Tyler Droste

(57) ABSTRACT

A resistance device for exercise bike and bike trainer wherein the resistance is generated and adjusted by the rotation of a conductor and movement of one or a group of permanent magnets proximate to the conductor. The resistance training apparatus of the present disclosure can include a housing, a controller that connects to a computer, one or more sensors, a conductor/brake disk configured to rotate around a first axis, a magnet holding assembly for holding one or more magnets, a drive motor that is controlled by the electronic board to precisely move the magnet holding assembly form a first position to a second position along a second axis, wherein resistance is generated and adjusted by the rotation of conductor/brake disk and the position of the one or more magnets relative to the conductor as the magnetic holding assembly moves along the second axis.

18 Claims, 8 Drawing Sheets

(56) References Cited

U.S. PATENT DOCUMENTS

| | | | | |
|---|---|---|---|---|
| 2010/0069205 | A1* | 3/2010 | Lee | A63B 21/0051 482/63 |
| 2017/0034430 | A1 | 2/2017 | Fu et al. | |
| 2019/0374808 | A1* | 12/2019 | Huang | A61B 5/224 |
| 2022/0096888 | A1* | 3/2022 | Hsu | A63B 21/00192 |
| 2022/0105388 | A1* | 4/2022 | Kuo | A63B 21/151 |
| 2022/0131454 | A1* | 4/2022 | Lin | H02K 49/046 |
| 2022/0347524 | A1* | 11/2022 | Kim | A63B 21/0056 |

* cited by examiner

RESISTANCE APPARATUS AND SYSTEM FOR EXERCISE EQUIPMENT

CROSS-REFERENCE TO RELATED APPLICATION

This U.S. Patent application claims priority to U.S. Provisional Application 63/292,952 filed Dec. 22, 2021, to the above-named inventors, the disclosure of which is considered part of the disclosure of this application and is hereby incorporated by reference in its entirety.

FIELD OF THE INVENTION

This invention relates to a powered resistance device on an exercise equipment that needs to create controlled resistance based on the speed of body movement, such as a stationary exercise bike (stationary bike), bike trainer and rowing machine. A stationary bike is a typical application for this invention, it will be used as example in this document. In this invention, equipment the resistance is created and adjusted by rotating a conductor and moving the magnets. The conductor rotation is driven by the rider while one or more magnets are driven by a motor and its output movement is precisely controlled by a controller or other computing device such as a computer, an electronic board with a microchip, a tablet or cellular phone. This resistance device also integrates a speed sensor and a torque sensor whose data can be used to calculate moving speed and moving power. In this document, the conductor is in round shape, so it is also referred as brake disk in some places.

BACKGROUND

In the cycling and fitness industry, almost all existing training or exercise bikes need to use some kind of resistance devices to simulate the riding resistance to reach the goal of training and exercise. The current resistance devices for training and exercise bikes, can be categorized into wind/fan resistance, friction resistance, magnet resistance, electromagnet resistance and electronic motor resistance from resistance source point of view; they can also be categorized into none-control, manual control and program control device from the control method point of view. All these resistance devices have their pros and cons considering function, resistance limits, prices and riding feeling.

In current market, friction resistance devices and simple magnet resistance devices are usually used on low-end exercise bikes, they are manually controlled and the resistance precision and measurement are not critical. They are low-cost and easy to setup, but they also have their limitations such as not being able to provide real riding experience and accurate riding data, and continuously manual resistance adjustment is bothersome as well.

Electromagnet or electric motor are usually seen on high-end exercise bikes and bike trainers, their resistance are usually controlled by a computer program. These resistance devices can simulate real riding feeling much better, and with the integration with various sensors, these resistance devices can collect big amount of riding data. However, these current devices are quite expensive, with some bike trainers are priced as high as several thousand US dollars due to the use of electromagnetic resistance devices and/or the use of electrical motors.

The present disclosure provides a new resistance device that can include one or more regular permanent magnets, a precise electronic motor, a brake disk, a magnet movement mechanism, an electronic board that receive resistance signals, and one or more sensors that can include a speed sensor and a torque sensor. The apparatus of the present disclosure can precisely control the movement of the all magnets along the radial direction of the brake disk from 100% overlap with the brake disk to 100% out of the brake disk, in this way it provides a much better way to calculate the resistance according to the relative position of the magnets and the brake disk. The integrated torque sensor provides very accurate measurement of movement power driven by a user. It balances the functions of high-end resistance devices and price to customers.

BRIEF SUMMARY OF THE INVENTION

In one aspect, this disclosure is related to a resistance training apparatus including a housing. A conductor can be positioned within the housing and coupled to a sidewall of the housing. The conductor can freely rotate around a first axis (X). A magnet holding assembly for holding one or more magnets can be positioned proximate to the conductor. A drive motor can be configured to move the magnet holding assembly from a first position to a second position along a second axis (Y). As the magnet holding assembly is moved along the second axis, the magnets position relative to the conductor changes which can affect the amount of resistance. Resistance can be generated and adjusted by the rotation of conductor and the position of the one or more magnets relative to the conductor as the magnetic holding assembly moves along the second axis. The second axis can be generally vertical or at a predetermined angle relative to the surface of the conductor. The second axis can be along any suitable direction relative to the conductor/brake disk.

The apparatus can include a guide rail assembly configured to guide the magnetic holding assembly along the second axis, wherein the guide rail assembly is positioned paralleled to the surface of the conductor. The controller can be communicatively coupled to the one or more sensors, the drive motor, and a computing means, wherein the controller can receive one or more data elements from the one or more sensors. One or more data elements can be used to determine a resistance signal and control the magnet movement along the second axis. In some exemplary embodiments, the one or more data elements can include one or more of the following: speed data, torque data, and magnet position data.

The one or more sensors can include a torque sensor configured to measure the torque data, wherein the torque data can be used by the controller and the computing system to determine an instant power calculation. Additionally, the one or more sensors can include a speed sensor configured to measure the speed of the conductor rotation around the first axis, the speed data can be used by the controller and the computing system to determine an instant power calculation. Other additional sensor can be utilized include a cadence sensor, rpm sensor, speed sensor, or any other suitable sensor.

The invention now will be described more fully hereinafter with reference to the accompanying drawings, which are intended to be read in conjunction with both this summary, the detailed description and any preferred and/or particular embodiments specifically discussed or otherwise disclosed. This invention may, however, be embodied in many different forms and should not be construed as limited to the embodiments set forth herein; rather, these embodiments are provided by way of illustration only and so that this disclosure will be thorough, complete and will fully convey the full scope of the invention to those skilled in the art.

DETAILED DESCRIPTION OF THE INVENTION

Figure 1:
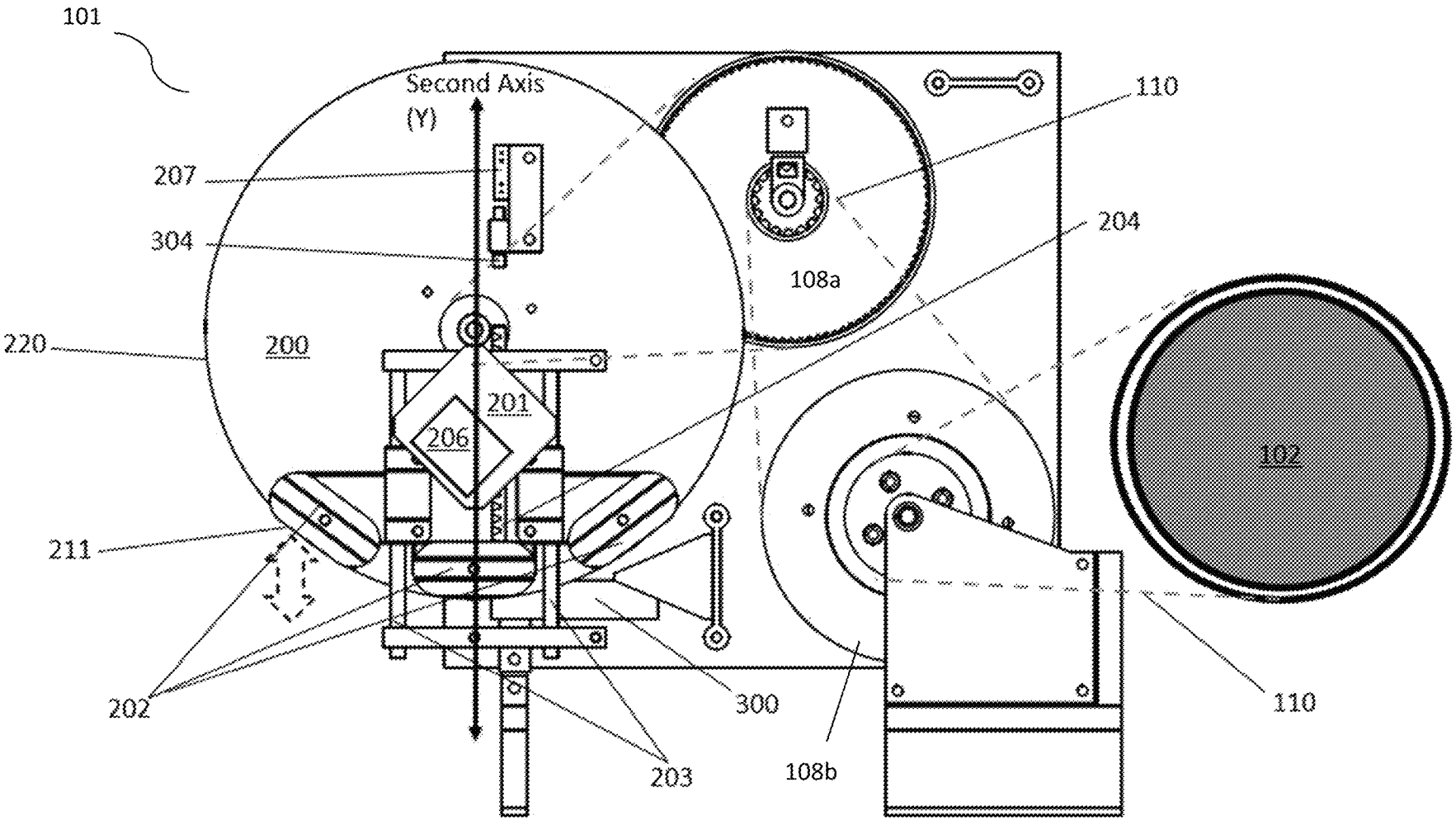
FIG. 1 is an illustration of a side view of an exemplary embodiment of a resistance training apparatus of the present disclosure.

The following detailed description includes references to the accompanying drawings, which forms a part of the detailed description. The drawings show, by way of illustration, specific embodiments in which the invention may be practiced. These embodiments, which are also referred to herein as "examples," are described in enough detail to enable those skilled in the art to practice the invention. The embodiments may be combined, other embodiments may be utilized, or structural, and logical changes may be made without departing from the scope of the present invention. The following detailed description is, therefore, not to be taken in a limiting sense.

Before the present invention of this disclosure is described in such detail, however, it is to be understood that this invention is not limited to particular variations set forth and may, of course, vary. Various changes may be made to the invention described and equivalents may be substituted without departing from the true spirit and scope of the invention. In addition, many modifications may be made to adapt a particular situation, material, composition of matter, process, process act(s) or step(s), to the objective(s), spirit or scope of the present invention. All such modifications are intended to be within the scope of the disclosure made herein.

Unless otherwise indicated, the words and phrases presented in this document have their ordinary meanings to one of skill in the art. Such ordinary meanings can be obtained by reference to their use in the art and by reference to general and scientific dictionaries.

References in the specification to "one embodiment" indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

The following explanations of certain terms are meant to be illustrative rather than exhaustive. These terms have their ordinary meanings given by usage in the art and in addition include the following explanations.

As used herein, the term "and/or" refers to any one of the items, any combination of the items, or all of the items with which this term is associated.

As used herein, the singular forms "a," "an," and "the" include plural reference unless the context clearly dictates otherwise.

As used herein, the terms "include," "for example," "such as," and the like are used illustratively and are not intended to limit the present invention.

As used herein, the terms "preferred" and "preferably" refer to embodiments of the invention that may afford certain benefits, under certain circumstances. However, other embodiments may also be preferred, under the same or other circumstances.

Furthermore, the recitation of one or more preferred embodiments does not imply that other embodiments are not useful and is not intended to exclude other embodiments from the scope of the invention.

As used herein, the terms "front," "back," "rear," "upper," "lower," "right," and "left" in this description are merely used to identify the various elements as they are oriented in the FIGS, with "front," "back," and "rear" being relative to the apparatus. These terms are not meant to limit the elements that they describe, as the various elements may be oriented differently in various applications.

As used herein, the term "coupled" means the joining of two members directly or indirectly to one another. Such joining may be stationary in nature or movable in nature. Such joining may be achieved with the two members or the two members and any additional intermediate members being integrally formed as a single unitary body with one another or with the two members or the two members and any additional intermediate members being attached to one another. Such joining may be permanent in nature or alternatively may be removable or releasable in nature. Similarly, coupled can refer to a two member or elements being in communicatively coupled, wherein the two elements may be electronically, through various means, such as a metallic wire, wireless network, optical fiber, or other medium and methods. The various components of the system can be communicatively coupled to each other. Network can include, for example, a local area network (LAN), a wide area network (WAN), cable system, telco system, Bluetooth®, NFC, Internet, Wi-Fi or other wireless connection.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element without departing from the teachings of the disclosure. The resistance apparatus for training equipment, including but not limited to a stationary exercise bike (stationary bike) or bike trainer is shown and described herein.

An exemplary embodiment of the resistance apparatus 101 of the present disclosure can apply resistance utilizing one or more features of the apparatus 101. A first feature can include resistance created by an Eddy current and the strength of the resistance can be controlled by changing the distance between a conductor 200 and one or more magnet (s) 202 that can be both vertically and horizontally positioned proximate to the conductor 200 of the resistance apparatus 101.

Figure 2:
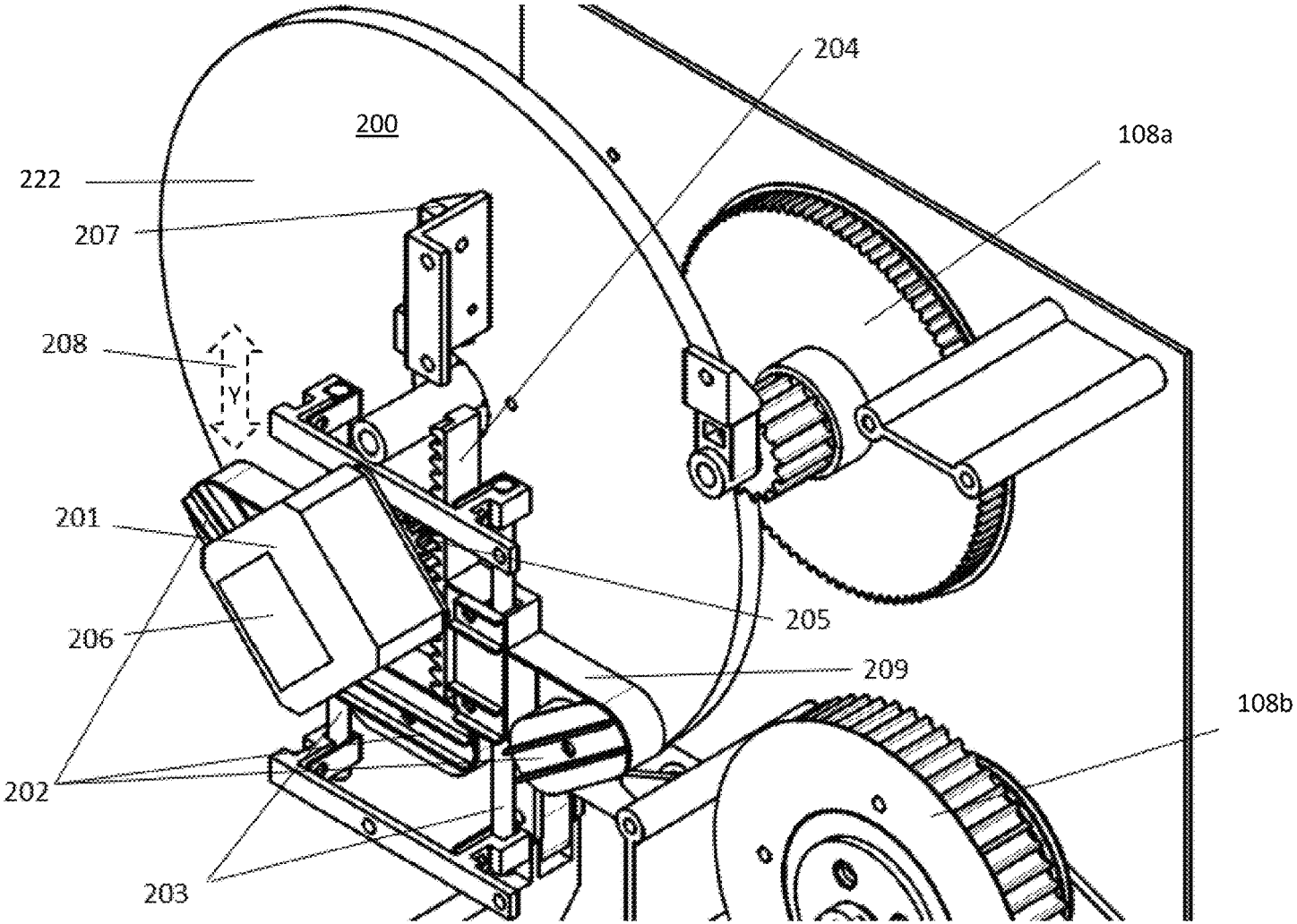
FIG. 2 is an illustration of a perspective view of an exemplary embodiment of a resistance training apparatus of the present disclosure.
Figure 3:
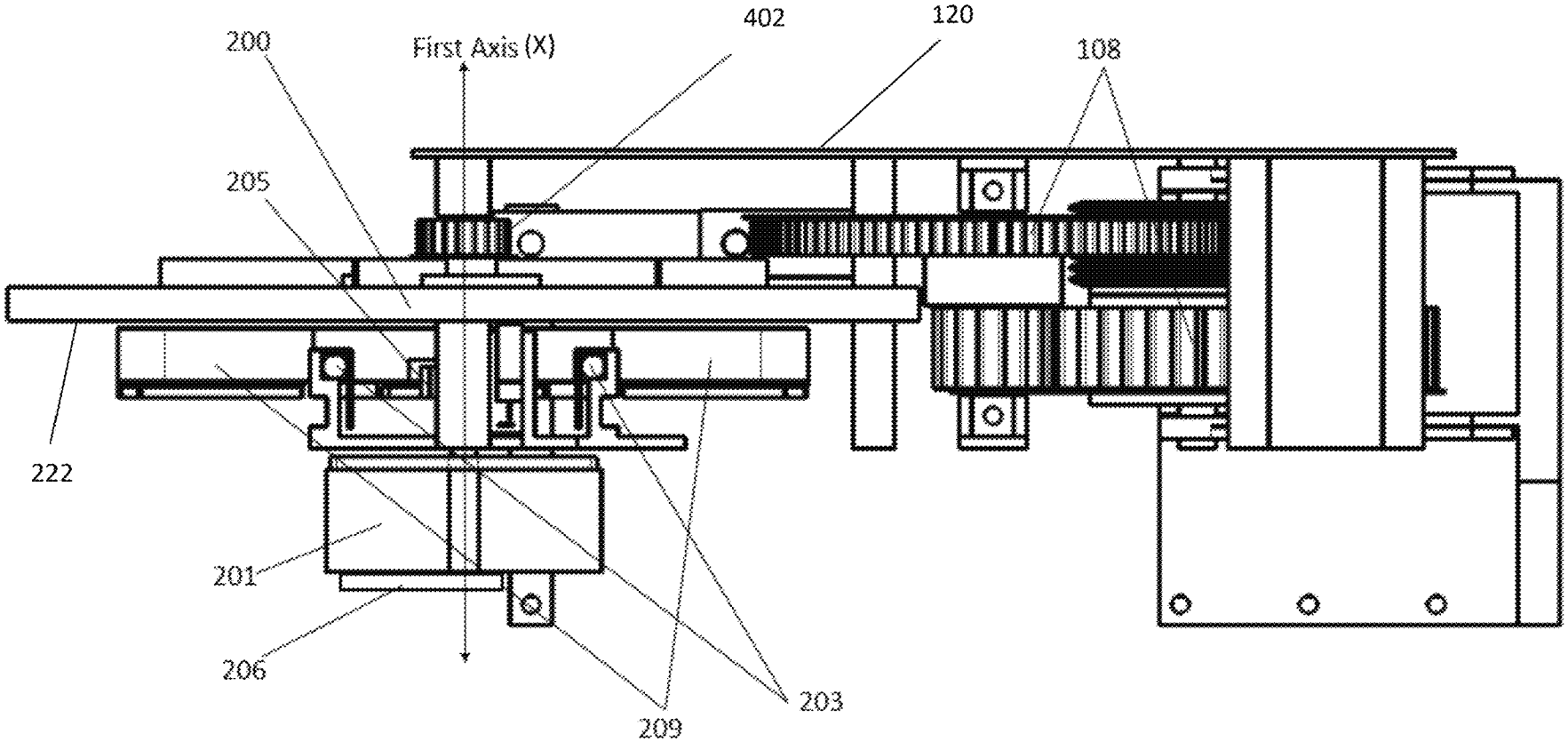
FIG. 3 is an illustration of a top view of an exemplary embodiment of a resistance training apparatus of the present disclosure.
Figure 4:
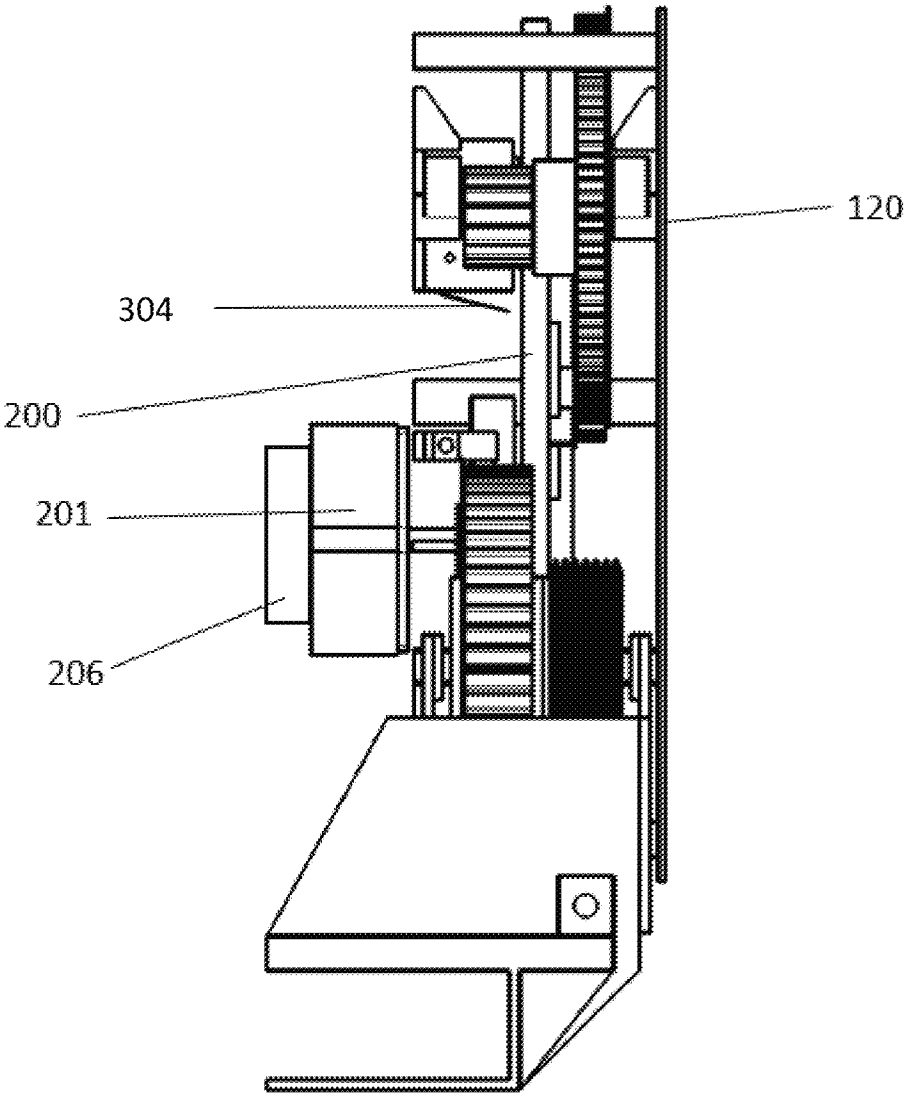
FIG. 4 is an illustration of a back view of the inventive device with main components displayed, some components may be blocked by other components.

Furthermore, the resistance can be adjusted and or controlled by various elements of the resistance apparatus 101, including but not limited to by moving the conductor 200 around a first axis as shown in FIG. 3, movement of the one or more magnets 202 relative to the conductor 200, and the strength of the magnet(s) 202 utilize. An exemplary embodiment of the resistance apparatus 101 of the present disclosure can use varying strength permanent magnets 202 in various embodiments. In some exemplary embodiments, a second resistance feature can include a motor 201 that can move the magnet(s) 202 and or magnet holder assembly 209 containing the magnet(s) 202 along an axis. In some exemplary embodiments, the motor 201 can be a step motor or the linear actuator, the movement of which can be precisely controlled by an external signals and/or controller 206, which in turn can control the resistance precisely applied to the conductor 200. A plurality of magnets with the same or varying strengths can be positioned proximate to the conductor. In some exemplary embodiments, the apparatus can utilize three magnets position along an arc that approximates the perimeter radius edge 220 of the conductor 200. A motor 201 can move the one or more magnets in one or more directions/axis 208 with respect to the conductor 200 as shown in FIGS. 1-4.

Figure 8:
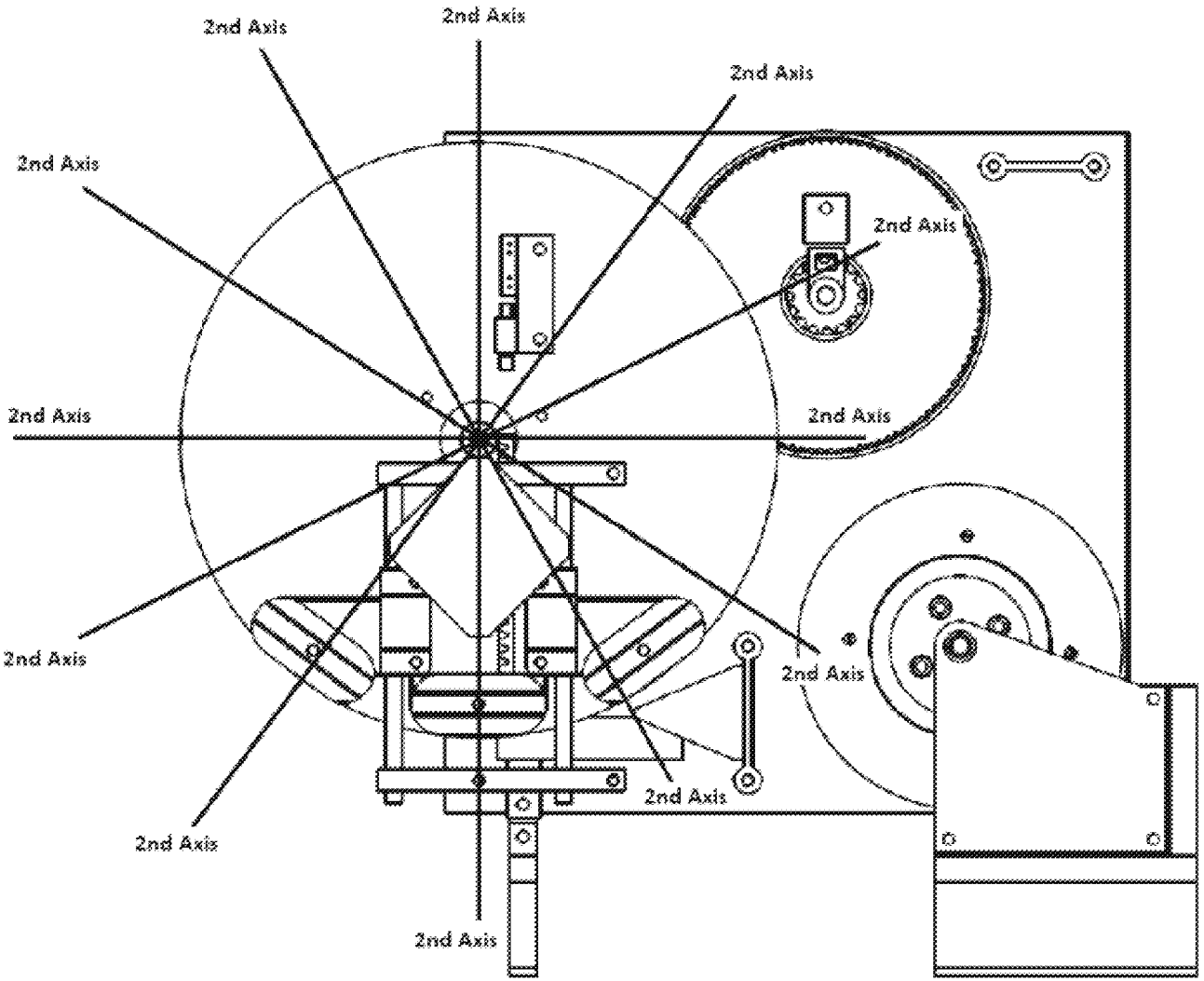
FIG. 8 is a diagram of an exemplary embodiment of a resistance training apparatus of the present disclosure and various axis of travel of the magnets relative to the conductor.

In some exemplary embodiments, the second axis can be any directional axis including but not limited to a vertical axis as shown in FIG. 1. In some embodiments, the second axis can be at any suitable angle relative to the surface 222 of the conductor as shown in FIG. 8. The movement of the magnets 202 along the second axis from a first position to a second position resulting in a change of resistance to the conductor 200. In some exemplary embodiments, the first position can have the magnet(s) 202 position proximate to the central axis of the conductor 200. In this position the entire surface of the magnet(s) 202 can be positioned over the surface of the conductor 200. Alternatively, the second position can have the magnet position proximate to the outer edge 220 of the conductor 200. In some positions only a portion of the magnet surface will overlay the conductor. If no external resistance is desired, the magnet(s) 202 can be moved into a third position wherein the magnet surface does not overlay any portion of the conductor 200. The speed of the rotation of the conductor 200 can also affect the resistance exerted by the magnets 202 and the position of the magnets 202 relative to the conductor 200. The controller 206 and computing system 210 can monitor the resistance generated as the conductor 200 is being rotated. In some exemplary embodiments, the computing system 210 and controller 206 can be incorporated into a single computing device. A user can in real-time control the resistance applied through the computing system 210. Similarly, the computing system can provide a prescribed resistance program 214 that can alter the resistance applied by the apparatus 101 of the present disclosure. The computer 210 can additionally take the real-time resistance feedback data and other data to actuate the motor 201 to move the magnet(s) 202 from the current position to maintain a desired or prescribed resistance to the user.

Figure 6:
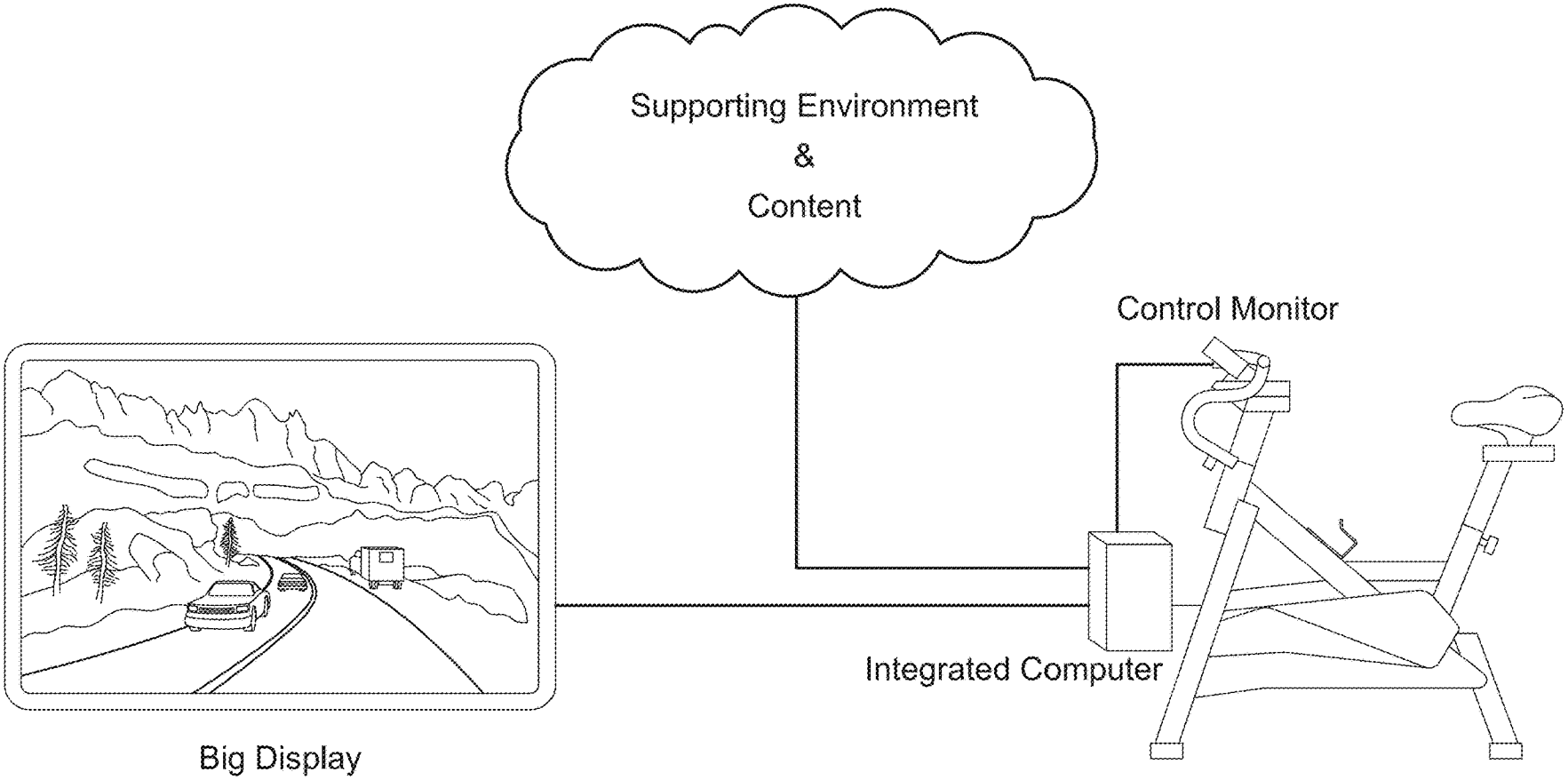
FIG. 6 is a diagram of an exemplary embodiments of a training apparatus of the present disclosure used with a cycling system and program.

In one exemplary embodiment, wherein the system 500 requires a fixed resistance the computing system 210 and controller 206 can initiate the drive motor 201 to move along the second axis as the speed of the rotation of the conductor 200 changes to maintain the desired resistance. A resistance program 214 stored on a memory 212 can be initiated that can initiate the movement of the magnets 202 by the motor(s) 201 to create the desired resistance based upon the initiated resistance program 214. In some exemplary embodiments, the computer 210 can be communicatively coupled to a cloud database or server 216 as shown in FIG. 6. The server 216 can be accessed by the computer utilizing any suitable network.

While there are several ways to control the distance between the conductor 200 and the magnet(s) 202, they present different feasibility and accuracy to precise resistance control. In some exemplary embodiments of the present disclosure, the vertical distance between a conductor 200 and a magnet(s) 202 can be fixed, and the horizontal distance between the conductor and the magnet(s), which can include a single magnet holder, can be adjusted by moving the magnet(s) 202 along the radial direction of the conductor 200. Due to the one or more magnet(s) 202 are aligned with the edge of the conductor 200 and move at the same time at same pace, the resistance is easier to calculate and control during operation.

Figure 7:
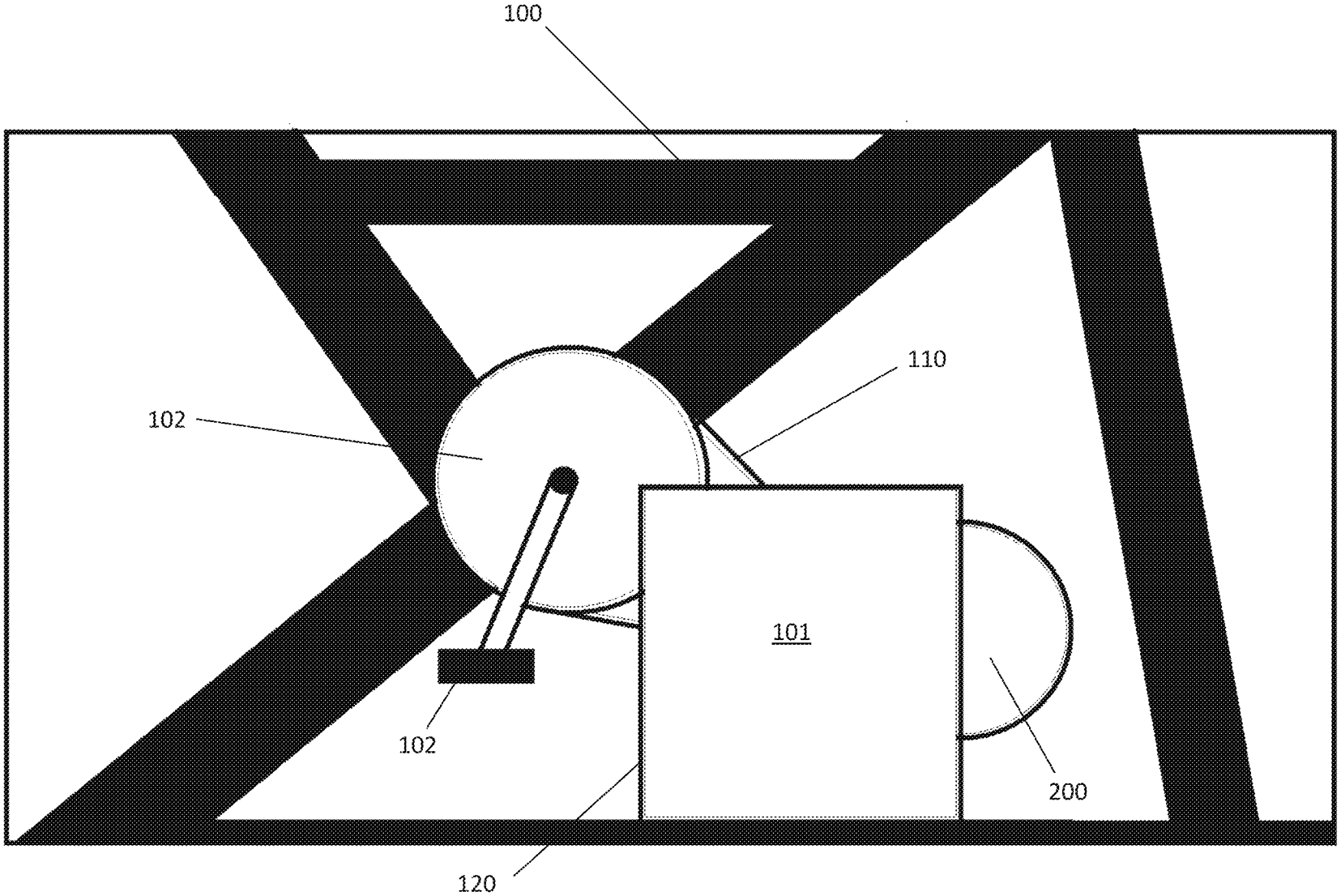
FIG. 7 is an image of an exemplary embodiment of a resistance training apparatus of the present disclosure coupled to a stationary bicycle.

FIG. 7 depicts an overview of an example of the resistance apparatus 101 of the present disclosure that is applied on a stationary exercise bike (stationary bike) 100. When a rider pedals the stationary bike 100, the driving wheel 102 can drive a belt or chain 1 or other means to transfer the movement to the resistance device 101. A coupling means can couple the conductor to the drive rotor assembly. In some exemplary embodiments, the apparatus 101 can use a drive rotor assembly that can include one or more gears/pulleys to aid in driving the conductor by the user from the driving wheel 102. In one exemplary embodiment, the drive rotor assembly can include two sets of internal gears/pulley 108*a,b* sets to transfer the pedal movement to a conductor 200. In some exemplary embodiments applications the number of internal gears/pulley set can be adjusted based on different requirements and desired gear/pulley transfer ratios, it is possible that the driving wheel 102 can drive the conductor 200 directly. The various gears/pulleys can be coupled mechanically coupled together with one or more chains/belts 110 as shown in FIG. 1. In other embodiments, the conductor 200 be directly coupled to the driving wheel 102 or alternatively operate as the driving wheel 102 thereby eliminating the need for a belt/chain 110. The various components of the resistance apparatus of can be housed or partially housed within a housing 120. The housing 120 can also be utilized to couple one or more of the various components of the resistance apparatus as shown in FIGS. 1-4.

As shown in FIG. 2, various components of an exemplary embodiment of the resistance apparatus 101 of the present disclosure are shown. A motor 201 can drive a straight gear rack 204 along one or more magnet guiding rails 203 toward the center or the edge of the conductor 200 through the step motor gear 205 at the tip of its axle. One or more sensors can be utilized to determine speed, torque, and other metrics. The sensors can be communicatively coupled to a controller 206. The controller 206 can further be communicatively coupled to a step motor 201 that can drive the magnet holder assembly 209 along the second axis 208 as shown in FIG. 2.

In some exemplary embodiments one or more magnet guiding rails 203 can be positioned parallel to the radial direction of the conductor 200. The guide rails 203 can guide a magnet holder assembly 209 as it moves along a magnet moving direction/axis 208. At the end (bottom) of the straight gear rack 204 one or more magnets 202 can be coupled to the magnetic holder assembly 209. The bottom edge 211 of the magnet holder assembly 209 can align with the edge of the conductor 200. One or a group of magnets 202 can be inserted into the magnet holder 209 depends on the maximum desired resistance, these magnets 202 can be placed along the edge of the magnet holder assembly 209 and with same pole (for example all North pole or all South pole) face paralleled to the surface of the conductor 200, all these are for easy resistance calculation and control.

Based on the Eddy current theory, when the conductor 200 starts to rotate around its axis, a resistance is generated by the movement and its strength is affected by the distance between the conductor 200 and the magnet(s) 202, both vertically and horizontally positioned to the conductor 200. In one exemplary embodiment, the vertical distance between the surface 222 of conductor 200 and magnets 202 is constant, but through the movement of the straight gear rack 204, magnet(s) 202 can be totally moved out of the edge 220 of the conductor 200, which generates the least resistance or no resistance, or the magnet(s) 202 can be moved along the Y axis to completely overly with surface 222 of the conductor 200, which generates the most resistance to the conductor 200. Other alternative embodiments, can allow for the magnets to also or alternatively moved closer or further from the surface 222 of the conductor 200. Similarly, the magnets 202 can be moved anywhere along one or more axis to partially or completely overly the conductor 200 to create a desired resistance level for a user. The magnet holding assembly 209 can be moved between a first position and a second position by the step motor 201. In some exemplary embodiments, the step motor 201 can also be a controllable linear actuator that push the magnet holder 209 up and down along the magnet guiding rails 203.

Figure 5:
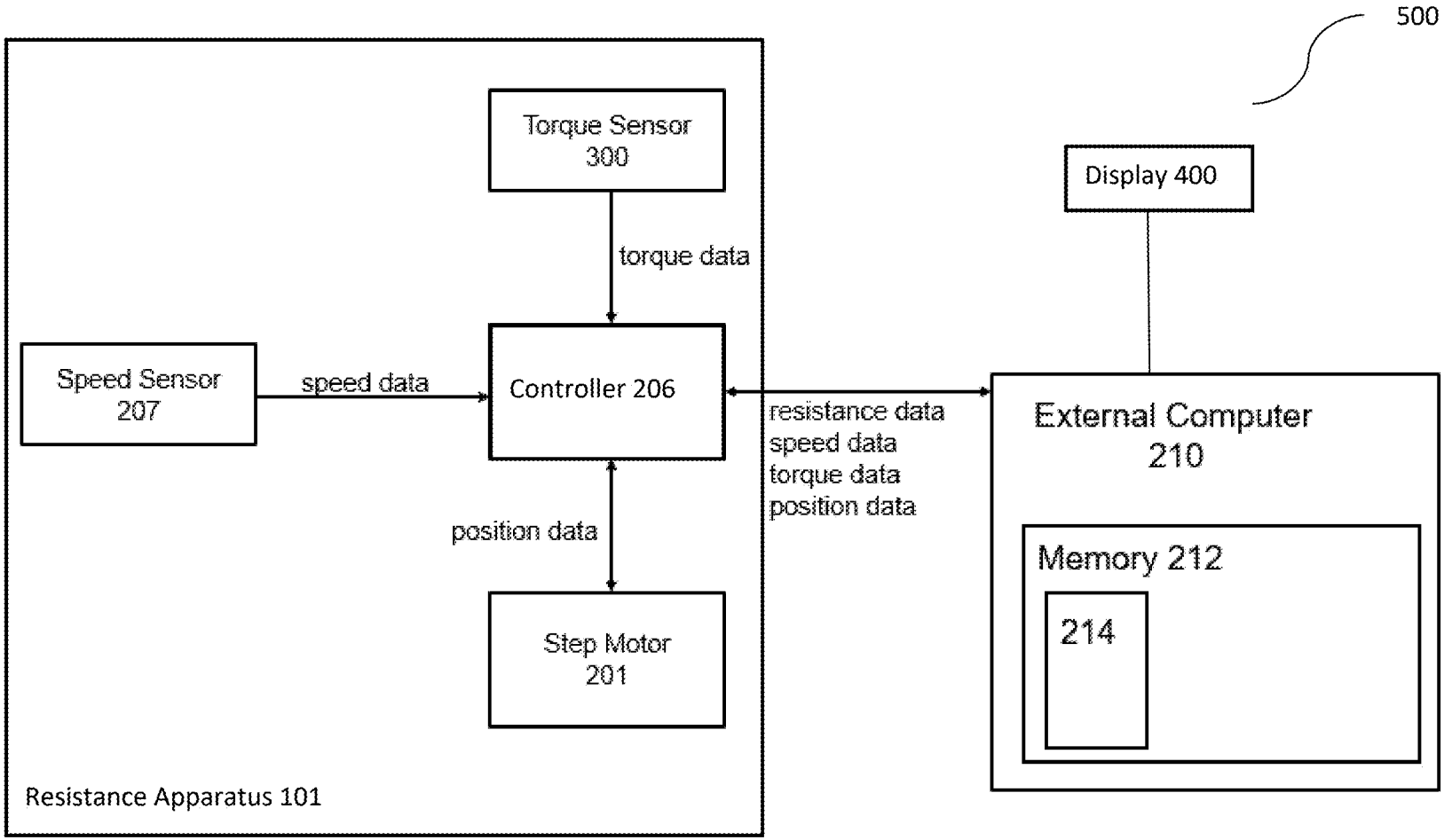
FIG. 5 is a block diagram of a resistance training system of the present disclosure.

As shown in FIG. 2 a controller 206 can be communicatively coupled to the step motor 201 directly or can be positioned in any spare place in or out of the resistance device 101 housing 120. The controller 206 can receive one or more data points, including but not limited to speed data from a speed sensor 207, torque data from a torque sensor 300, and send them to the external program or controller such as a computer or smart device such as phone or tablet. As shown in FIG. 5, the computing means 210 can be communicatively coupled to the controller 206 via any suitable connection, including but not limited to Wifi, Bluetooth®, ANT+, NFC, etc. At the same time the controller 206 can receive resistance data from an external program and converts them to the signal that controls the movement of the step motor 201 to thereby adjust the position of the magnets 202 relative to the edge 220 and/or surface 222 of the conductor 200.

Similarly, in other embodiments, the one or more sensors can be communicatively coupled to either the controller 206, the computing means 210, or both. The sensors, controller, step motor, and computing means can all be communicatively coupled to allow for the flow of data and signals to be transmitted between the various elements of the system 500. In some embodiment, the computing means can communicated to the controller and/or to step motor based upon a step value that can be generated based upon resistance and position relative to conductor 200 as to whether the position of the magnet assembly needs to be moved relative to the conductor 200. Additionally, as shown in FIG. 6, the resistance apparatus and system of the present disclosure can be communicatively coupled to one or more displays 218 and 400 that can further provide data elements generated by the computing means as well as can display visual environments to a user.

FIG. 1 illustrates the components from the side view of the resistance apparatus of the present disclosure. In one exemplary embodiment, two internal gears/pulleys 108*a* and 108*b* can be seen sit inside the resistance device housing 120 and can be used to mechanically couple/transfer the movement of driving wheel 102 to the conductor 200. The number of internal gears/pulleys 108 will depend on application requirement, and can be one or more. In some embodiments, the resistance apparatus can use zero gears/pulleys 108 and let the external driving wheel 102 drives the conductor 200 directly. Belt/chains 110 can help transfer the rotational energy between the various gears/pulleys 108. In some embodiments, the apparatus 101 can utilize a single sensor that can capture various data elements. In other embodiments, a torque sensor 300 positioned proximate to the edge of the conductor 200 to measure the torque created by the resistance, and can send torque data back to the controller 206 and can be further used to calculate the instance power being generated by the apparatus 101. In some exemplary embodiments, the torque sensor 300 can be coupled to the one or more magnet guide rails 203.

A position switch or sensor 304 can be installed above the straight gear rack 204 that can communicatively connect the switch 304 to the controller 206. When the position switch 304 is touched by the top of the straight gear rack 204, it can send a signal to controller to let it know the absolute position of the straight gear rack 204 and subsequently the position of the magnets 202. The position switch 304 plays a critical role when initialize the positions of the straight gear rack 204, the step motor 201 and the magnet holder 209. In other embodiment, a position sensor can be utilized to determine the absolute position of the straight gear rack 204 and the magnetic holder assembly 209. The position sensor can be any suitable sensor, including but not limited to a linear positions sensor.

In some exemplary embodiments, the controller and motor 201 can be utilized to identify the relative position of the magnets 202 relative to the edge 220 of the conductor or relative to the center of the conductor 200. The controller and/or computing device can utilize one or more data points collected by the one or more sensors to determine the resistance of the apparatus 101, as well as be utilized to movement of the magnets 202 relative to the conductor 200. In some exemplary embodiments, the data points can be utilized by the controller and/or computing system to generate a resistance signal. The system 101 can utilize the resistance signals to move the position of the one or more magnets 202 relative to the conductor 200. Similarly, the various data can be utilized to determine an instant power calculation generated by the user. The system can monitor and obtain various data elements, including but not limited to resistance data, speed data, torque data, position data, cadence data, rotations per minute, and power output among other data elements.

As further shown in FIG. 3, a step motor gear 205 can be utilized to drive the magnet holder assembly 209 up and down along a vertical axis as the step motor gear 205 interfaces with gear rack assembly 204. Additionally, the conductor/brake disk pulley 402 can utilize a chain/belt 110 to mechanically couple the conductor/brake disk pulley 402 to one or more gears/pulleys. It should be understood that other exemplary embodiments can utilize various means to move the magnetic holder assembly 209 up and down the vertical axis, such as a linear motor or actuator. The conductor 200, step motor 201, controller 206, a couple of internal gear/pulley sets and some support structure can be seen from this figure. The position switch 304 can be clearly seen in FIG. 4.

While the invention has been described above in terms of specific embodiments, it is to be understood that the invention is not limited to these disclosed embodiments. Upon reading the teachings of this disclosure many modifications and other embodiments of the invention will come to mind of those skilled in the art to which this invention pertains, and which are intended to be and are covered by both this disclosure and the appended claims. It is indeed intended that the scope of the invention should be determined by proper interpretation and construction of the appended claims and their legal equivalents, as understood by those of skill in the art relying upon the disclosure in this specification and the attached drawings.

What is claimed is:

1. A resistance training apparatus comprising:

a housing coupled to an exercise apparatus, wherein the housing supports the following components:

one or more sensors, a conductor positioned to rotate around a first axis, a guide rail assembly configured to guide a magnet holding assembly along a second axis, wherein the guide rail assembly is positioned parallel to a first surface of the conductor on only a first side of the conductor, wherein the first surface of the conductor is perpendicular to the first axis, wherein the magnet holding assembly comprises a first magnet positioned proximate to the first side of the conductor, a drive motor configured to move the magnet holding assembly along a plurality of positions between a first position to a second position along the second axis, wherein a resistance is generated and adjusted by the rotation of the conductor and a position of the first magnet relative to the conductor as the magnetic holding assembly moves along the second axis;

wherein the components are configured to be mounted to a side wall of the housing;

and a controller communicatively coupled to the one or more sensors, drive motor, and a computing system, wherein the controller receives one or more data elements from the one or more sensors, sends the one or more data elements to a computing device to determine the resistance signal and identify the relative position of the guide rail assembly and first magnet to the conductor, and sends position data to the drive motor.

2. The resistance training apparatus of claim 1, wherein the conductor is coupled to a drive rotor assembly, wherein the drive rotor assembly is coupled to the sidewall of the housing.

3. The resistance training apparatus of claim 2, wherein the drive motor can control the position of the first magnet relative to the conductor based upon a resistance signal transmitted to the controller.

4. The resistance apparatus of claim 3, wherein the magnet holding assembly further comprises a second magnet and a third magnet, wherein the first magnet, second magnet, and third magnet, are positioned along an arc that approximates a perimeter radius edge of the first surface of the conductor.

5. The resistance apparatus of claim 4, wherein the magnet holding assembly is moved between a plurality of positions between a first position and a second position to adjust the resistance as the conductor is rotated.

6. The resistance apparatus of claim 5, wherein the first magnet and second magnet have different strengths.

7. The resistance training apparatus of claim 3, wherein the conductor and the drive rotor assembly are coupled together utilizing at least one of the following: a chain, a belt, or a direct drive gear.

8. The resistance apparatus of claim 3, wherein the drive rotor assembly is coupled to a first gear, wherein the first gear is coupled to a second gear, wherein the second gear is coupled to the conductor, wherein the first gear is coupled to a driving wheel of the exercise apparatus.

9. The resistance training apparatus of claim 1, wherein the one or more data elements are configured to be used to determine a resistance signal and control the position of the magnet holding assembly along the second axis to maintain a predetermined resistance.

10. The resistance training apparatus of claim 9, wherein the one or more sensors comprise a speed sensor configured to measure the speed of the conductor rotation around the first axis, the speed data can be used by the controller and the computing system to determine an instant power calculation.

11. The resistance training apparatus of claim 10, wherein the brake disk rotation data is collected by the one or more sensors.

12. The resistance training apparatus of claim 9, the one or more data elements are selected from the list consisting of: speed data, torque data, position data, and combinations thereof.

13. The resistance training apparatus of claim 9, wherein the one or more sensors comprise a torque sensor configured to measure the torque data, wherein the torque data is configured to be used by the controller and the computing system to determine an instant power calculation.

14. The resistance training apparatus of claim 1, wherein the second axis is a vertical axis with respect to the first surface of the conductor.

15. The resistance training apparatus of claim 1, wherein the second axis is a horizontal axis with respect to the first surface of the conductor.

16. The resistance apparatus of claim 1, further comprising a step motor gear coupled to the drive motor, wherein the guide rail assembly further includes a straight gear rack interfacing the step motor gear, wherein the drive motor drives the step motor gear to move the guide rail assembly along the second axis parallel to the first surface of the conductor, wherein and a position switch positioned above the straight gear rack is positioned for determining an absolute position of the straight gear rack.

17. The resistance apparatus of claim 1, further comprising a memory for storing one or more resistance programs, wherein the controller is communicatively coupled to the memory and the controller can initiate a selected resistance program from the one or more resistance programs to move the magnet holding assembly based upon the selected resistance program.

18. A resistance training apparatus for coupling to an exercise apparatus, comprising: a housing coupled to an exercise apparatus, wherein the housing supports the following components:

one or more sensors, a conductor positioned to rotate around a first axis, a guide rail assembly configured to guide a magnet holding assembly along a second axis, wherein the guide rail assembly is positioned parallel to a first surface of the conductor on only a first side of the conductor, wherein the first surface of the conductor is perpendicular to the first axis, wherein the magnet holding assembly comprises a first magnet positioned proximate to the first side of the conductor, a drive motor configured to move the magnet holding assembly along a plurality of positions between a first position to a second position along the second axis, wherein a resistance is generated and adjusted by the rotation of the conductor and a position of the first magnet relative to the conductor as the magnetic holding assembly moves along the second axis, and a drive rotor assembly, wherein the drive rotor assembly is coupled to the sidewall of the housing and to configured to drive the conductor to rotate around the first axis;

wherein the components are configure to be mounted to a sidewall of the housing, and a controller communicatively coupled to the one or more sensors, drive motor, and a computing system, wherein the controller receives one or more data elements from the one or more sensors, sends the one or more data elements to a computing device to determine the resistance signal and identify the relative position of the guide rail assembly and first magnet to the conductor, and sends position data to the drive motor;

and a memory for storing one or more resistance programs, wherein the controller is communicatively coupled to the memory and the controller can initiate a selected resistance program from the one or more resistance programs to move the magnet holding assembly based upon the selected resistance program.

* * * * *